US009290894B2

(12) United States Patent
Eul

(10) Patent No.: US 9,290,894 B2
(45) Date of Patent: Mar. 22, 2016

(54) ROAD PAVER WITH MEASURING DEVICE

(75) Inventor: Achim Eul, Mannheim (DE)

(73) Assignee: JOSEPH VOGELE AG, Ludwigshafen/Rhein (DE)

( * ) Notice: Subject to any disclaimer, the term of this patent is extended or adjusted under 35 U.S.C. 154(b) by 410 days.

(21) Appl. No.: 13/586,588

(22) Filed: Aug. 15, 2012

(65) Prior Publication Data

US 2013/0051913 A1 Feb. 28, 2013

(30) Foreign Application Priority Data

Aug. 22, 2011 (EP) ..... 11006864

(51) Int. Cl.
*E01C 23/07* (2006.01)
*E01C 19/00* (2006.01)
*E01C 19/48* (2006.01)

(52) U.S. Cl.
CPC ..... *E01C 23/07* (2013.01); *E01C 19/006* (2013.01); *E01C 19/48* (2013.01)

(58) Field of Classification Search
USPC ..... 404/84.1, 84.05, 84.5; 701/50
See application file for complete search history.

(56) References Cited

U.S. PATENT DOCUMENTS 4,818,107 A * 4/1989 Ono et al. ..... 356/622
5,471,391 A * 11/1995 Gudat et al. ..... 701/50
5,964,298 A * 10/1999 Greenspun ..... 172/4.5
6,916,070 B2 7/2005 Sehr
7,044,680 B2 * 5/2006 Godbersen et al. ..... 404/75
7,856,302 B2 * 12/2010 Rasmussen ..... 701/50
8,600,589 B2 * 12/2013 Mendez-Rodriguez et al. ..... 701/16
2004/0068896 A1 4/2004 Sehr
2004/0158355 A1 * 8/2004 Holmqvist et al. ..... 700/245
2004/0161299 A1 8/2004 Smith
2007/0214687 A1 * 9/2007 Woon et al. ..... 37/415
2010/0014916 A1 * 1/2010 Green ..... 404/84.1
2010/0129152 A1 5/2010 Taylor
2011/0255918 A1 * 10/2011 Worsley et al. ..... 404/84.1
2012/0083982 A1 * 4/2012 Bonefas et al. ..... 701/70
2012/0323432 A1 * 12/2012 Wong et al. ..... 701/25

FOREIGN PATENT DOCUMENTS

DE 19951297 C1 4/2001
DE 10060903 A1 7/2002
DE 102009044581 A1 6/2010
EP 2293013 A2 3/2011

OTHER PUBLICATIONS

Extended European Search Report dated Nov. 15, 2013 for EP Patent No. 13188708.5-1604.
English translation of European Search Report dated Dec. 6, 2011 which issued in corresponding European Patent Application No. 11006864.
European Search Report mailed Dec. 6, 2011, which issued in corresponding European Application No. 11006864.
(Continued)

*Primary Examiner* — Abigail A Risic
(74) *Attorney, Agent, or Firm* — Fish & Richardson P.C.

(57) ABSTRACT

Road paver having a towing machine that is movable on a plane along a work area, and a screed provided to lay a road pavement, and having at least one measuring device configured to generate a point cloud that depicts a three-dimensional condition of the surface of the plane.

7 Claims, 3 Drawing Sheets

(56) References Cited

OTHER PUBLICATIONS

Chinese Office Action which issued Jul. 30, 2015 in corresponding Chinese Application No. 201210299715.2, with English translation thereof.

Zhang, Qi-fu et al., 3D Scanning Instrument Measuring Method and Prospect Forecast, Beijing survey and drawing; 1st phase, pp. 39-41, Feb. 28, 2011, with English abstract thereof.

* cited by examiner

ROAD PAVER WITH MEASURING DEVICE

FIELD OF THE INVENTION

The present invention relates to a road paver having at least one measuring device that is configured to register a surface.

BACKGROUND OF THE INVENTION

A road paver as it is known in practice essentially comprises a towing machine that is movable on a plane along a work area, as well as a screed that is provided for laying the road pavement. The screed is normally mounted, in such a way that it can pivot, on the towing machine by means of a tow arm that is rigidly connected to the screed.

The height of the tow arm can be controlled by the operator in order to raise the screed to a desired level relative to the road pavement. In this way it is possible to adjust, depending on the condition of the surface of the subgrade, the screed position in such a way that unevennesses in the subgrade across which the road paver drives are balanced out. This results in the creation of a level road pavement layer. Today automatic measuring systems are also used that register a distance to a reference in order to create, in reaction to the same, as promptly as possible a levelling signal which is used to determine the position of the screed.

Used for such measuring systems are, for example, mechanical sensors that are mounted on the movable screed in such a way that they come into contact with the surface of the plane in front of the newly laid road pavement in order to register unevennesses upon it in good time. Disadvantageous in this is, however, that a mechanical sensor can register unevennesses on a hard subgrade only, because such a sensor does not respond to unevennesses on a soft, for example, sandy, subgrade. Furthermore, it is possible for the mechanical sensor that is slid across the plane to bang into an object that is lying around and consequently the sensor becomes damaged. The mechanical sensors must likewise be maintained periodically and they are sensitive to dirt and moisture.

As an alternative to the mechanical, contacting measuring devices, in practice contactless measuring systems are also used in order to register a distance to the plane. Such measuring systems comprise, for example, an optical or acoustic sensor system.

According to a further technique in road construction, a reference wire is used along the paving section as a reference for the distance measurement. The distance between the measuring head and the reference wire is thereby registered in order to make it possible to infer unevennesses on the road surface and correspondingly carry out a levelling of the screed. The attachment of a reference wire along the paving section is, however, extremely laborious and requires a great deal of time. Furthermore, it is possible that the reference wire, which is normally a normal rope, sags so much across a section due to absorbed moisture that falsified distance values are registered for the levelling.

To level the screed, in practice rotating lasers are also used which are positioned as an external reference in such a way that a laser rotation field that they span can be received by a receiver arranged on the road paver in the case of an appropriate height adjustment of the screed. The height of the screed is then adjusted if the receiver on the road paver no longer receives the rotational laser field of the rotating laser. Disadvantageous in this is, however, that the rotating laser must be repositioned along the paving section repeatedly, with additional operating personnel being required for this purpose.

In the case of the previously described systems for distance measurement, the registration of unevennesses on the plane is possible to only a limited degree. The present invention therefore is based on the object of improving a road paver with simple, constructive technical means to the effect that it makes it possible to lay an improved road pavement layer.

This object is achieved with the road paving device of the present invention.

The invention relates to a road paver having a towing machine that is movable on a plane along a work area, and having a screed that is provided for laying a road pavement. The road paver according to the invention furthermore comprises a measuring device that is configured in such a way that it registers a surface and generates a virtual point cloud that represents the surface. The registered surface can be depicted using the point cloud, whereby the point cloud extends in three spatial dimensions relative to the measuring device in order to depict a spatial depiction of the surface. The point cloud thereby comprises a plurality of points, each of which is defined by 3D coordinates. For spatial depiction of the surface, it is provided that at least one pair of points of the point cloud is aligned in a first direction, preferably in the direction of travel, and at least one other pair of points of the point cloud lies at an angle to the first direction, preferably to the direction of travel.

By means of the registration of the surface condition in the form of a point cloud, it is possible to collect valuable information that can be used to generate different operating settings. The invention offers the essential technical advantage that unevennesses, for example, transverse and longitudinal inclinations in the road profile, can be registered meaningfully and precisely. As a result, the setting of different operating parameters, such as the levelling signal, for example, can be improved in reaction to the subgrade on which the paver moves.

The invention is likewise impervious to poor weather and offers an economical, low-maintenance alternative to devices of this kind known until now. In addition, the measuring device is simple to operate and can be mounted on the road paver without a large effort. Furthermore, the invention makes it possible to dispense with additional measuring equipment that is formed to register transverse inclinations in the course of the road.

In an advantageous embodiment of the invention, the point cloud defines a surface condition of an area of the plane and/or of the road pavement. The measurement of the area can thereby extend across a varying length and a varying width, so that the registered surface section has different sizes. It is also possible to adjust the measurement of the area to a surface condition of the plane that is to be expected, so that it is possible, for example, in the case of uneven paving areas, to select the measurement of the area for determining the surface condition ahead of time in such a way that as a result it is possible to depict a sufficiently large point cloud. On the other hand, it can be expedient, especially in the case of a curving paving run, to select a smaller measurement of the area for determining the surface condition.

In a further embodiment of the invention, the measuring device comprises a filter unit that is configured to filter out extreme 3D coordinates from the point cloud. In this way, it is possible to disregard the registration of undesired objects. This can be advantageous particularly when the generated point cloud registers sections of the towing machine or of the screed. It is likewise in this way possible to filter out components that project into the point cloud. Finally, it is possible that operating personnel who are in the registration range of the point cloud can be filtered out of the measurement result.

For an especially reliable registration of the point cloud, the measuring device comprises a 3D scanner. This preferably comprises at least one optical sensor that is provided to register a distance to the registered surface. In an improved embodiment of the invention, the 3D scanner is a laser scanner with at least one laser sensor. The laser scanner is suitable for use even in poor weather and ensures precise registration of the point cloud.

The 3D scanner preferably comprises at least one movable mirror in order to deflect the light beam of the at least one optical sensor. It is thereby conceivable that the movable mirror can be controlled by a predetermined movement sequence so that the deflected light beam, preferably a laser beam, runs across the predetermined area that represents the point cloud. For faster registration of the point cloud, a plurality of movable mirrors can be provided in order to deflect different laser beams in such a way that the point cloud can be depicted.

The area of the point cloud can preferably be defined with at least 300 laser scan points. Due to this number of laser scan points, it is possible to generate a meaningful surface image, meaning the point cloud, in order to detect unevennesses on the registered surface.

As an alternative to the 3D scanner by means of movable mirrors, it is provided to equip the measuring device with a plurality of laser sensors which are arranged in a matrix, meaning in a sensor support, in such a way that they emit laser beams across the predetermined area for generating the point cloud. It can likewise be advantageous if the measuring device is arranged movably, so that it conducts the laser beams across the area for generating the point cloud by means of a predetermined movement sequence. The movement of the measuring device can thereby ensure that the laser beams of the laser sensors hit the surface to be registered linearly in a sequence, aligned in parallel, or that the measuring device is movable in such a way that the laser beams register the area from the outside inwards or from the inside outwards.

In a further embodiment of the invention, the road paver comprises a controller that is connected to the measuring device. The controller is preferably configured to convert the point cloud registered by the measuring device into a corresponding signal in order with it to control a certain operating function of the road paver. The controller is, however, preferably configured to convert the point cloud registered by the measuring device into at least one levelling signal. The levelling signal can be used to actuate the levelling cylinders of the road paver in order that consequently a movement of the screed can be carried out. The unevennesses spatially registered by the point cloud therefore influence the generation of the levelling signal in order to move the screed. As a result, it is possible to lay a flat road pavement particularly on uneven roads.

In a further embodiment of the invention the measuring device comprises a holding element with which the measuring device can be mounted on the road paver. In order for registration to be possible by means of differently sized point clouds, the holding element can be formed in such a way that it can be adjusted in the height, for example, in such a way that it is telescopically extendible, in order to arrange the measuring device at different heights. An especially useful measurement for the area of a point cloud can be generated by means of arranging the measuring device at a distance of up to ten meters above the plane.

In an especially advantageous execution, the measuring device is configured to regulate the point cloud as well as the parameter setting that results from it by means of real-time registration. If the parameter setting here involves the generation of a levelling signal, this can react to unevennesses in the subgrade without a time delay.

It is furthermore possible that in an embodiment of the invention at least one measuring device is provided on the left and/or right of the road paver, seen in the direction of travel. In this way, it is possible to generate a plurality of point clouds by means of which the surface condition of the plane or of the road pavement can be depicted.

It is advantageous, however, if the measuring device is configured such that it generates the point cloud for an area to the left and/or right alongside the work area. For example, it is advantageous if it is possible to register the point cloud in the work area within a short distance of the screed.

It is also possible that, using one or more registered point clouds, an average value can be generated by the controller in order to generate a signal for further operating functions of the road paver using the generated average value. This offers the technical advantage that a plurality of surface sections are taken into account when preparing an operating parameter.

The measuring device can also be configured in such a way that it generates the point cloud for an area that partially overlaps a section of the work area. It thereby does not matter whether the point cloud overlaps an area of the screed, an area of the towing machine or other technical means present on the road paver. As a result, the measuring device can be used especially flexibly on the road paver.

The measuring device is preferably arranged on the movable screed, however, particularly on the tow arm that supports the screed. On the other hand, the measuring device can, however, also be arranged on the towing machine of the road paver.

In order to register unevennesses on an especially large area, the measuring device can be configured in such a way that it generates the point cloud across an area that surrounds the road paver. Because it is possible to mask out extreme 3D coordinates, meaning in this case the towing machine and the screed, it is possible to depict a meaningful result by means of the surface sections of the point cloud that are to the left or right of or in front of or behind the road paver, whereby this result represents the surface condition of the work area.

According to an advantageous embodiment of the invention, the measuring device is formed to register the 3D coordinates of the surface by means of a pulse duration, phase difference in comparison to a reference or by means of triangulation of optical beams. In this way, a precise distance measurement between the measuring device and the surface is made possible.

BRIEF SUMMARY OF THE DRAWINGS

Embodiments according to the invention are described on the basis of the drawings. Shown are.

DETAILED DESCRIPTION OF THE INVENTION

Figure 1:
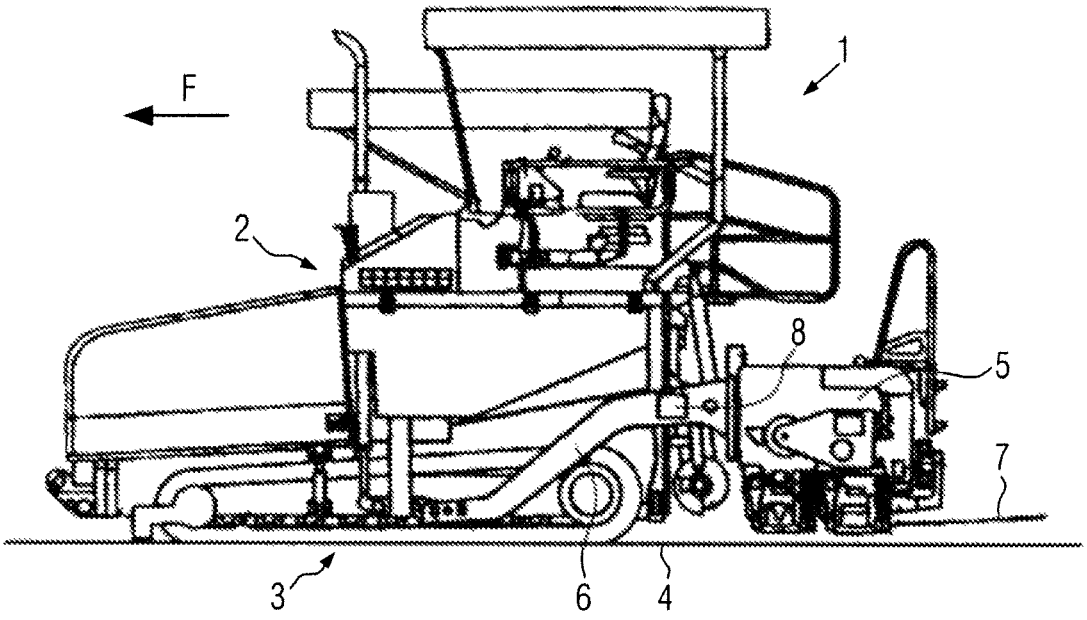
FIG. 1 a road paver according to the invention with a measuring device.

FIG. 1 shows a road paver 1 in the direction of travel F according to the invention. The road paver 1 comprises a towing machine 2 with an undercarriage 3, which moves on a plane 4. The road paver 1 furthermore comprises a screed 5 that is connected to the towing machine 2 of the road paver 1 in a movable manner by means of the tow arm 6. A new road pavement 7 is laid on to the plane 4 by the screed 5. Even if the plane 4, meaning the surface of the subgrade, is depicted so as to be flat in FIG. 1, in reality unevennesses are present on the plane 4. The road pavement 7 has a flat surface, even if the plane 4 lying underneath it has unevennesses.

This can be achieved by means of appropriate levelling of the screed 5, as is described in the following.

A measuring device 8 is mounted on the tow arm 6 of the road paver 1. The measuring device 8 is configured to register a three-dimensional surface section 9 (see FIG. 2) of the plane 4. The measuring device 8 is mounted at a short distance from the screed 5, on the tow arm 6. The measuring device 8 is formed to register unevennesses of the plane 4 by means of the registered three-dimensional surface section 9, in order from this to determine certain operating parameters for the road paver during the paving. For example, it is possible that, using the three-dimensionally registered surface section 9, a levelling signal can be generated by the measuring device 8 for controlling the screed 5, whereby the levelling signal can result in a position relocation of the screed 5.

Figure 2:
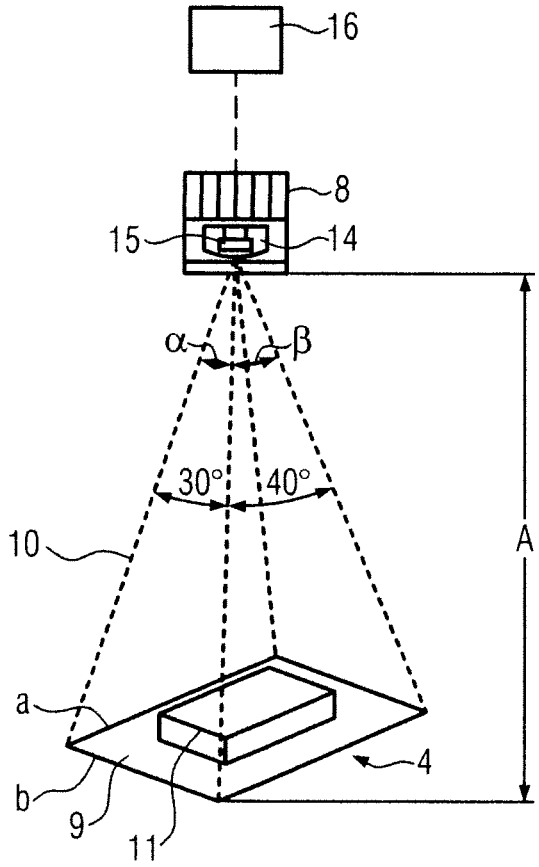
FIG. 2 the measuring device as it is used for the road paver according to the invention, and FIG. 3 a point cloud that describes the surface condition.

FIG. 2 shows the measuring device 8 as it is mounted on the tow arm 6 of the road paver 1 in FIG. 1. The measuring device 8 of FIG. 2 is configured to register the surface section 9 of the plane 4. The surface section 9 defines the surface condition of the plane 4 in sections. The surface section 9 is defined by a length a and a width b. The measuring device 8 is formed to vary the dimension of the surface section 9. For this purpose, settings can be made on the measuring device 8 that set up the length dimension a and/or the width dimension b. Dashed beams 10 are furthermore schematically shown in FIG. 2, whereby these beams are directed from the measuring device 8 to corner points of the surface section 9. The beams 10 enclose between them an angle $\alpha$ as well as an angle $\beta$, whereby depending on the height position of the measuring device 8 relative to the plane 4, a desired dimension can be registered for the surface section 9. As is shown in FIG. 2, the angle $\alpha$ can be 30° and the angle $\beta$ can be 40°. The measuring device 8, which is principally formed as a laser scanner 14, is configured to register the three-dimensional expansion of the plane 4 within the surface section 9 in order to ensure a spatial depiction of the surface.

FIG. 2 furthermore shows that the measuring device 8 is arranged at a height A above the plane 4. The height A is variable, whereby the measuring device 8 can be supported up to 10 meters above the subgrade. The measuring device 8 can, for example, be positioned at a height of 10 meters by a holder, not shown. In order to reproduce unevennesses on the plane 4 schematically, FIG. 2 shows a cuboid-shaped object 11, which lies on the surface section 9. The measuring device 8 is configured to register the object 11. Although the unevenness in FIG. 2 is shown with a cuboid shape, the unevenness on the plane 4 can have any shape.

Unevennesses on the plane 4 can, for example, comprise longitudinal or transverse inclinations of the subgrade on which the road paver 1 moves. Likewise, potholes or long-shaped ground subsidences or ground upheavals can be registered.

Figure 3:
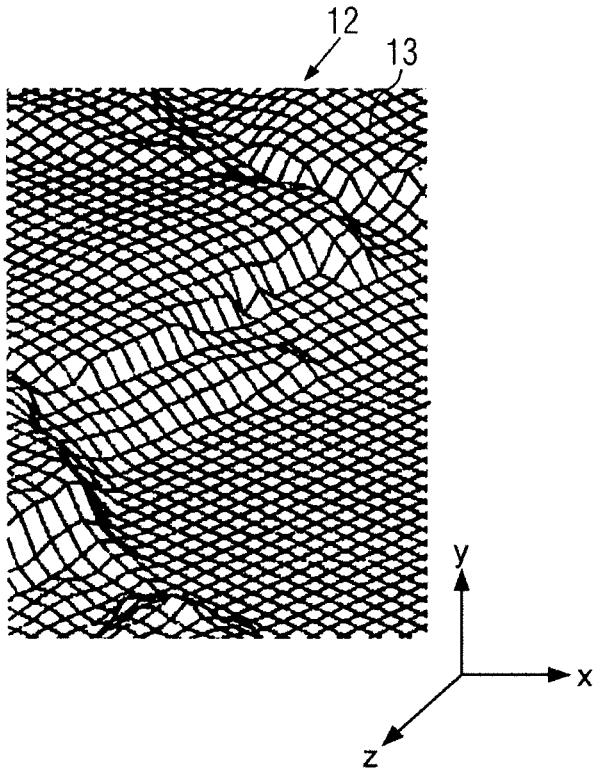

The measuring device 8 is configured to generate a virtual, net-like point cloud 12, which is shown in FIG. 3. The point cloud 12 depicts the surface section 9 in its three-dimensional condition. The point cloud 12 extends in three spatial dimensions relative to the measuring device 8 in order to ensure a spatial depiction of the surface of the plane 4. For this purpose, the point cloud 12 comprises a plurality of points 13 that are defined by 3D coordinates relative to the measuring device 8. In order to ensure the spatial depiction of the surface, at least one pair of points of the point cloud 12 is aligned in an arbitrary first direction, preferably in the direction of travel F, and at least one other pair of points of the point cloud 12 is aligned at an angle to the first direction, preferably to the direction of travel F. The measuring device 8 is formed to register unevennesses that are located within the surface section 9 by means of the point cloud 12 in order therewith to set up specific operating parameters of the road paver 1, for example, a levelling signal for controlling the position of the screed 5.

The invention claimed is:

1. Road paver having a towing machine movable on a plane along a work area and comprising a screed for laying a road pavement and at least one measuring device configured to register a surface that can be depicted as a point cloud by the measuring device, the measuring device comprising a 3D scanner to register the point cloud and a plurality of laser sensors that emit laser beams arranged in a matrix, the point cloud extends in three spatial dimensions relative to the measuring device to create a spatial depiction of the surface and comprises a plurality of points, each of said points being defined by 3D coordinates, wherein at least one pair of points of the point cloud is aligned in a first direction and at least one other pair of points of the point cloud lies at an angle to the first direction, and the measuring device being arranged movably to conduct the laser beams across an area for generating the point cloud with a predetermined movement sequence.

2. The road paver of claim 1 wherein the point cloud defines a surface condition of an area of the plane and/or of the road pavement.

3. The road paver of claim 1 wherein the measuring device is configured to filter out extreme 3D coordinates from the point cloud.

4. Road paver according to claim 1 wherein one measuring device is arranged on each side of the left and/or right, of the road paver, seen in the direction of travel.

5. Road paver according to claim 4 wherein the measuring device is configured to generate a point cloud for an area to the left and/or right alongside the work area.

6. Road paver according to claim 5 wherein the measuring device is configured to generate the point cloud for an area that partially overlaps a section of the work area.

7. Road paver according to claim 6 wherein the measuring device registers the 3D coordinates of the surface by means of the pulse duration, phase difference in comparison to a reference or by means of triangulation of optical beams.

* * * * *